US007036331B2

(12) United States Patent
Kim

(10) Patent No.: US 7,036,331 B2
(45) Date of Patent: May 2, 2006

(54) INTEGRATED AIR CONDITIONER HAVING CONDENSER CASING

(75) Inventor: Dae Dong Kim, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 36 days.

(21) Appl. No.: 10/819,314

(22) Filed: Apr. 7, 2004

(65) Prior Publication Data

US 2005/0039479 A1 Feb. 24, 2005

(30) Foreign Application Priority Data

Aug. 20, 2003 (KR) ..... 10-2003-0057453

(51) Int. Cl.
*F25D 23/12* (2006.01)

(52) U.S. Cl. ..... 62/262; 62/298

(58) Field of Classification Search ..... 62/262, 62/298, 428

See application file for complete search history.

(56) References Cited

U.S. PATENT DOCUMENTS 5,193,355 A * 3/1993 Matsumi ..... 62/262
5,203,400 A * 4/1993 Tsunekawa et al. ..... 165/59
5,467,610 A * 11/1995 Bolton et al. ..... 62/262
6,082,127 A * 7/2000 Correa ..... 62/262
6,422,028 B1 * 7/2002 Kim ..... 62/285

FOREIGN PATENT DOCUMENTS

KR 10-352477 8/2002

* cited by examiner

*Primary Examiner*—Melvin Jones
(74) *Attorney, Agent, or Firm*—Staas & Halsey LLP

(57) ABSTRACT

An integrated air conditioner having a condenser casing, prevents noise from being generated and prevents a condenser fan from being damaged or broken, due to contact between the condenser casing and the condenser fan. The condenser casing includes a front plate, an upper cover, and a plurality of coupling ribs between the front plate and the upper cover, to be spaced apart from each other at regular intervals. The condenser casing further includes a plurality of locking projections projected from a front edge of the upper cover toward the front plate, and a plurality of locking holes provided along an upper edge of the front plate. The locking projections are inserted into the corresponding locking holes after the coupling ribs are cut to separate the upper cover from the front plate, so that the upper cover is assembled with the front plate. The condenser fan is placed under the upper cover at a position in back of the locking projections.

20 Claims, 5 Drawing Sheets

INTEGRATED AIR CONDITIONER HAVING CONDENSER CASING

CROSS-REFERENCE TO RELATED APPLICATIONS

This application claims the benefit of Korean Patent Application No. 2003-57453, filed Aug. 20, 2003 in the Korean Intellectual Property Office, the disclosures of which are incorporated herein by reference.

BACKGROUND OF THE INVENTION

1. Field of the Invention

The present invention relates, in general, to integrated air conditioners and, more particularly, to an integrated air conditioner having a condenser casing, which prevents noise from being generated and prevents a condenser fan from being damaged or broken, due to contact between the condenser casing and the condenser fan.

2. Description of the Related Art

Typically, air conditioners are classified into two types, which are referred to as integrated air conditioners and separate-type air conditioners. In integrated air conditioners, an evaporator, a condenser, and a compressor are installed in a cabinet. On the other hand, in separate-type air conditioners, the evaporator is installed in an indoor unit which is placed in a room, while the condenser and the compressor are installed in an outdoor unit which is placed outside the room.

The cabinet of the integrated air conditioner is partitioned into a first interior chamber, which is placed in the room, and a second interior chamber, which is placed outside the room, by a partition, which is vertically arranged in the cabinet. In this case, the evaporator is placed in the first interior chamber, while the condenser and the compressor are placed in the second interior chamber. Further, a cooling fan is placed in the first interior chamber to draw the indoor air into the cabinet and pass the indoor air through the evaporator to be cooled prior to discharging cool air to the room. A condenser fan is placed in the second interior chamber to draw outdoor air into the cabinet and pass the outdoor air through both the condenser and the compressor prior to discharging the air to the outside, thus cooling the condenser and the compressor.

A condenser casing, which houses the condenser fan and the condenser therein, is also placed in the second interior chamber. The condenser casing functions to guide air from the condenser fan through the condenser to the outside so that the condenser is effectively cooled.

A conventional condenser casing includes a front plate, both side plates, and an upper cover. The front plate, both side plates, and the upper cover are integrally formed as a single structure to receive the condenser fan and the condenser in the condenser casing. The upper cover has a thin folding line part at a position which is spaced apart from the front plate by a predetermined distance. The upper cover is bent along the folding line part so that the condenser is installed under the upper cover having a predetermined length.

When the condenser casing having the front plate, the side plates, and the upper cover is prepared, a bending part of the upper cover, corresponding to a rear portion of the folding line part, stands upright to define an opening at a rear section of the upper cover between both side plates. In such a state, the condenser fan and the condenser are installed into the condenser casing through the opening defined between both side plates. Thereafter, the bending part is bent downward and rearward until the bending part is placed horizontally, and a rear end of the bending part is held on an upper surface of the condenser.

However, in the conventional condenser casing, the folding line part of the upper cover is continuously formed from a first side edge to a second side edge of the upper cover, and the condenser fan is installed under the folding line part. Thus, when the bending part of the upper cover is bent horizontally, and the rear end of the bending part is held on the condenser, after the condenser fan and the condenser are installed into the condenser casing, through the opening defined between the both side plates, a residual stress may be generated in the folding line part. This residual stress may remain in the folding line part in terms of structural damages. As an example, a result of the residual stress is that a portion around the folding line part sags.

Due to the sagging of the folding line part, the portion around the folding line part may come into contact with the condenser fan. When the condenser fan is rotated in such a state, due to the contact between the condenser fan and the portion around the folding line part which sags, noise is generated, and besides, cracks are generated in the condenser fan, resulting in damage or breakage of the condenser fan.

SUMMARY OF THE INVENTION

Accordingly, it is an aspect of the present invention to provide an integrated air conditioner having a condenser casing, which prevents noise from being generated and prevents a condenser fan from being damaged or broken, due to contact between the condenser casing and the condenser fan.

The above and/or other aspects are achieved by an integrated air conditioner having a condenser casing which houses a condenser and a condenser fan therein, and includes a front plate, an upper cover, and a plurality of coupling ribs. The coupling ribs are arranged along a horizontal direction between the front plate and the upper cover, to be spaced apart from each other at regular intervals. The upper cover and the front plate are integrally formed as a single structure while being coupled to each other by the coupling ribs. In this case, the upper cover upwardly extends from the front plate.

The condenser casing may further include a plurality of locking projections which are projected from a front edge of the upper cover toward the front plate, and a plurality of locking holes which are provided along an upper edge of the front plate to receive the locking projections therein. The locking projections are inserted into the corresponding locking holes after the coupling ribs are cut to separate the upper cover from the front plate, so that the upper cover is assembled with the front plate.

The locking projections may be inserted into the locking holes in front of the condenser fan which is provided under the upper cover, so that the condenser fan is operated at a position which is offset from the locking projections.

Each of the locking projections may be shorter than each of the coupling ribs.

Further, a hook may be integrally projected from an inner surface of the upper cover at a position around a rear edge of the upper cover to lock the upper cover to the condenser.

The hook may be provided with an arc-shaped groove corresponding to a shape of a refrigerant pipe which constitutes the condenser, so that the hook is fitted over the refrigerant pipe.

Further, a screw hole may be formed at a rear portion of the upper cover to screw the upper cover to an upper end of the condenser, thus allowing the upper cover to be locked to the condenser, in cooperation with the hook.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more easily appreciated from the following description of the embodiments, taken in conjunction with the accompanying drawings of which.

DETAILED DESCRIPTION OF THE PREFERRED EMBODIMENTS

Figure 1:
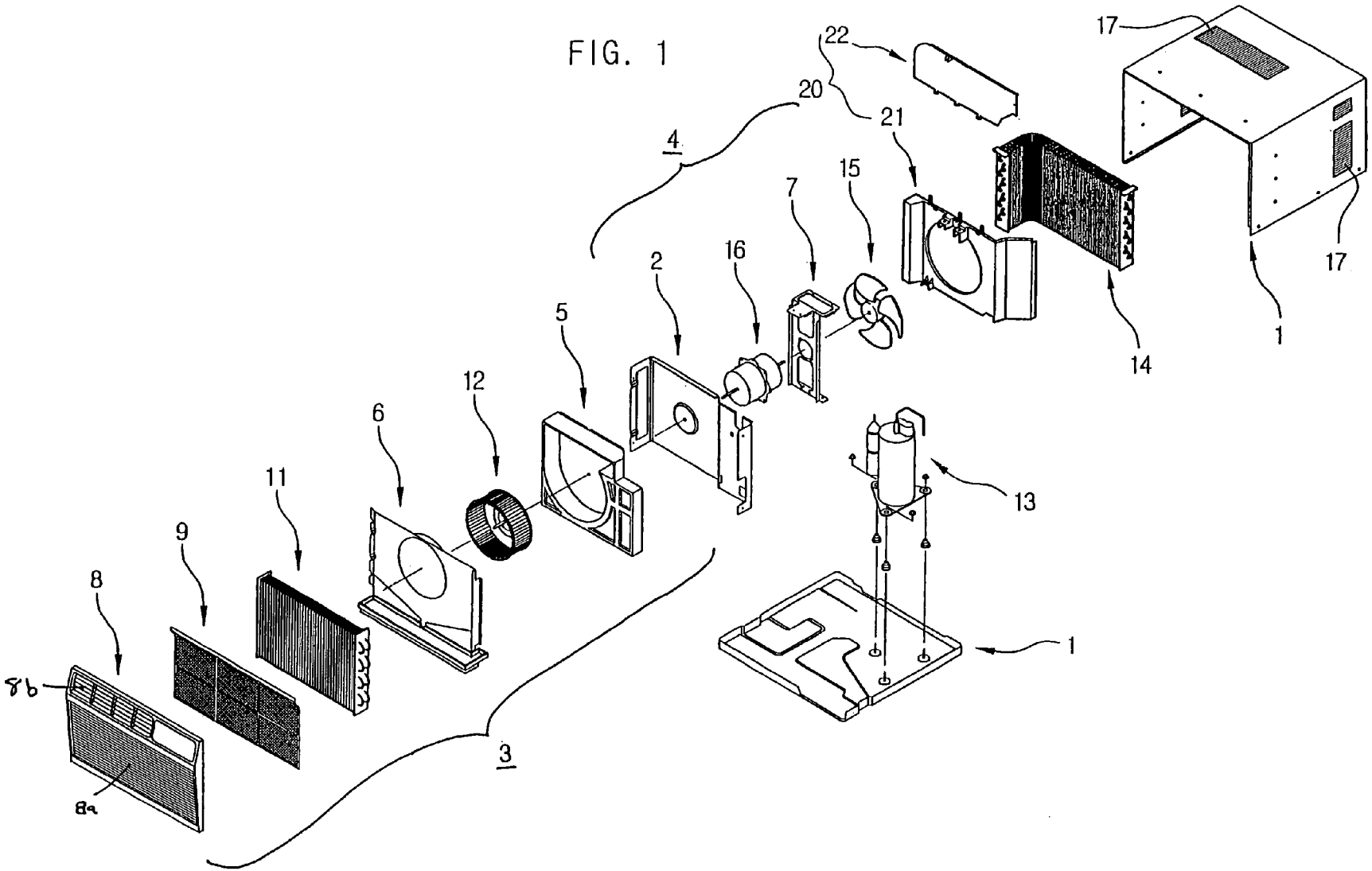
FIG. 1 illustrates an exploded perspective view of an integrated air conditioner having a condenser casing, according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

FIG. 1 is an exploded perspective view of an integrated air conditioner having a condenser casing, according to an embodiment of the present invention. As shown in FIG. 1, the integrated air conditioner includes a cabinet 1 which is box-shaped and defines an external appearance of the integrated air conditioner. The cabinet 1, which includes a cover and a base panel, extends inside a room, into which the cabinet 1 is installed, from outside the room. An evaporator 11, a cooling fan 12, a compressor 13, a condenser 14, and a condenser fan 15 are installed in the cabinet 1. The evaporator 11 and the cooling fan 12 cool indoor air. A refrigerant, which circulates through a refrigerant pipe forming a closed circuit to execute a phase change is compressed in the compressor 13. The condenser 14 and the condenser fan 15 function to condense the gas refrigerant fed from the compressor 13.

The cabinet 1 is partitioned into a first interior chamber 3 which is placed in the room and a second interior chamber 4 which is placed outside the room, by a partition 2 which is vertically arranged in the cabinet 1. In this case, the evaporator 11 and the cooling fan 12 are placed in the first interior chamber 3, while the compressor 13, the condenser 14, and the condenser fan 15 are placed in the second interior chamber 4.

The cooling fan 12 of the first interior chamber 3 and the condenser fan 15 of the second interior chamber 4 are connected to a drive motor 16 which is placed in the second interior chamber 4, so that the cooling fan 12 and the condenser fan 15 are simultaneously operated. The cooling fan 12 is set in a fan casing 5 which is mounted to a front of the partition 2. The evaporator 11 is mounted to a front of an evaporator frame 6 which is placed in front of the fan casing 5.

A motor frame 7 is mounted to a rear portion of the partition 2 to fix the drive motor 16. A condenser casing 20 to house the condenser 14 and the condenser fan 15 therein, is placed in back at the motor frame. The condenser casing 20 includes a front plate 21 and an upper cover 22, which are integrally formed as a single structure. The front plate 21 and the upper cover 22, which are prepared in this way, are separated from each other before being assembled. The assembly of the front plate 21 and the upper cover 22 will be described later herein.

A front panel 8 which has an inlet port 8*a* and an outlet port 8*b*, is mounted to a front of the cabinet 1. A filter 9 is placed between the front panel 8 and the evaporator 11 to filter air which flows into the cabinet 1 through the front panel 8.

Further, a rear panel (not shown) is mounted to a rear end of the cabinet 1, and has an outlet port to discharge outdoor air from the second interior chamber 4 to an outside of the cabinet 1. Inlet ports 17 are provided on an upper surface and both side surfaces at a rear portion of the cabinet 1 so that the outdoor air flows into the second interior chamber 4 through the inlet ports 17.

In the integrated air conditioner constructed as described above, when the compressor 13 and the drive motor 16 are operated to rotate the cooling fan 12, indoor air flows into the first interior chamber 3 through the inlet port 8*a* of the front panel 8, passes through the evaporator 11, and then is discharged to the room through the outlet port 8*b* of the front panel 8, thus lowering room temperature. Simultaneously, by an operation of the condenser fan 15, outdoor air flows into the second interior chamber 4 through the inlet ports 17 to cool the compressor 13 and the condenser 14. Subsequently, the air is discharged to the outdoor through the outlet port of the rear panel (not shown). Through such an operation, the room maintains a preset temperature.

The assembly of the condenser casing according to an embodiment of the present invention will be described in detail in the following with reference to FIGS. 2 to 5.

Figure 2:
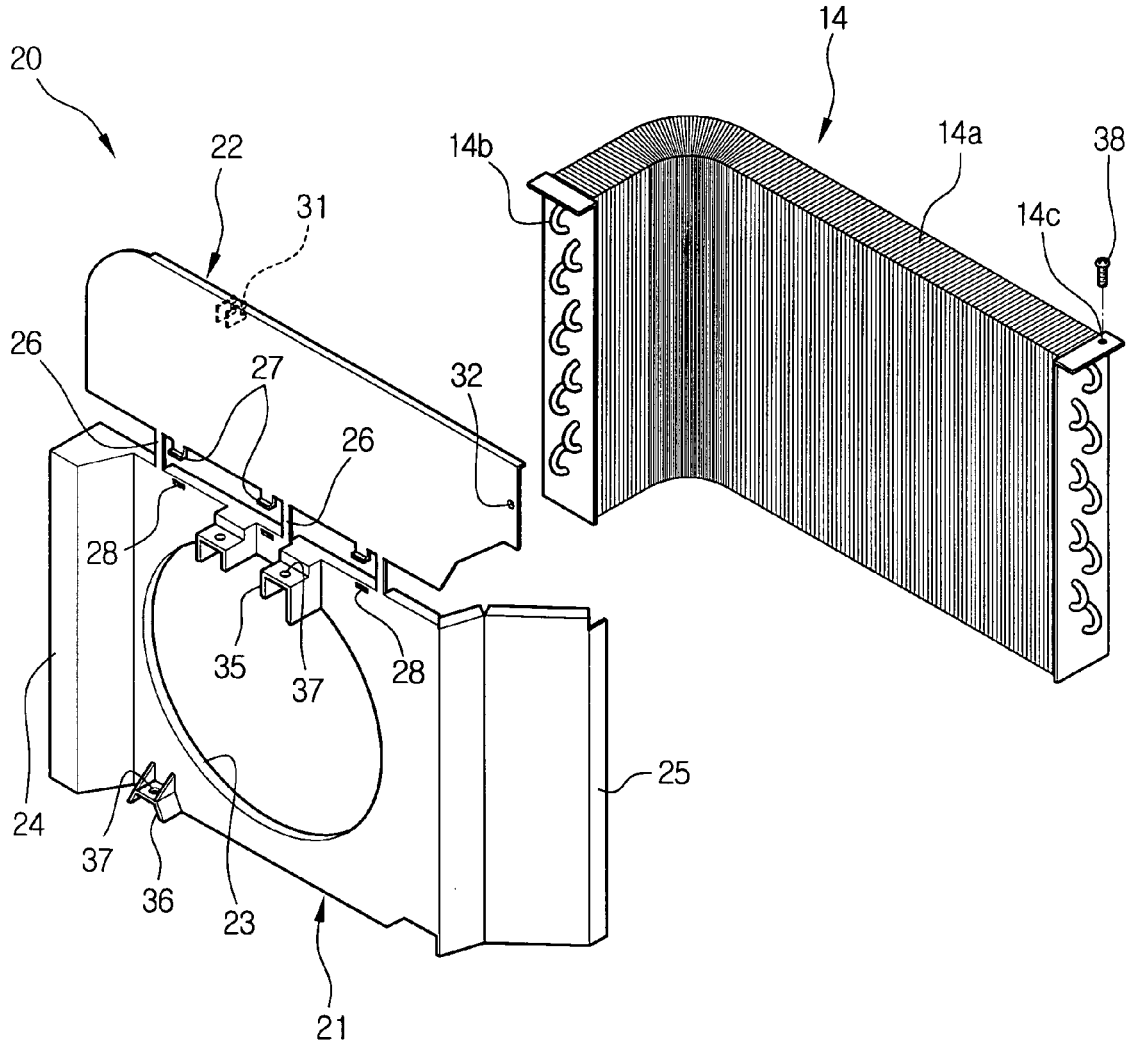
FIG. 2 illustrates a perspective view of a condenser and the condenser casing included in the integrated air conditioner of FIG. 1, prior to being assembled.
Figure 3:
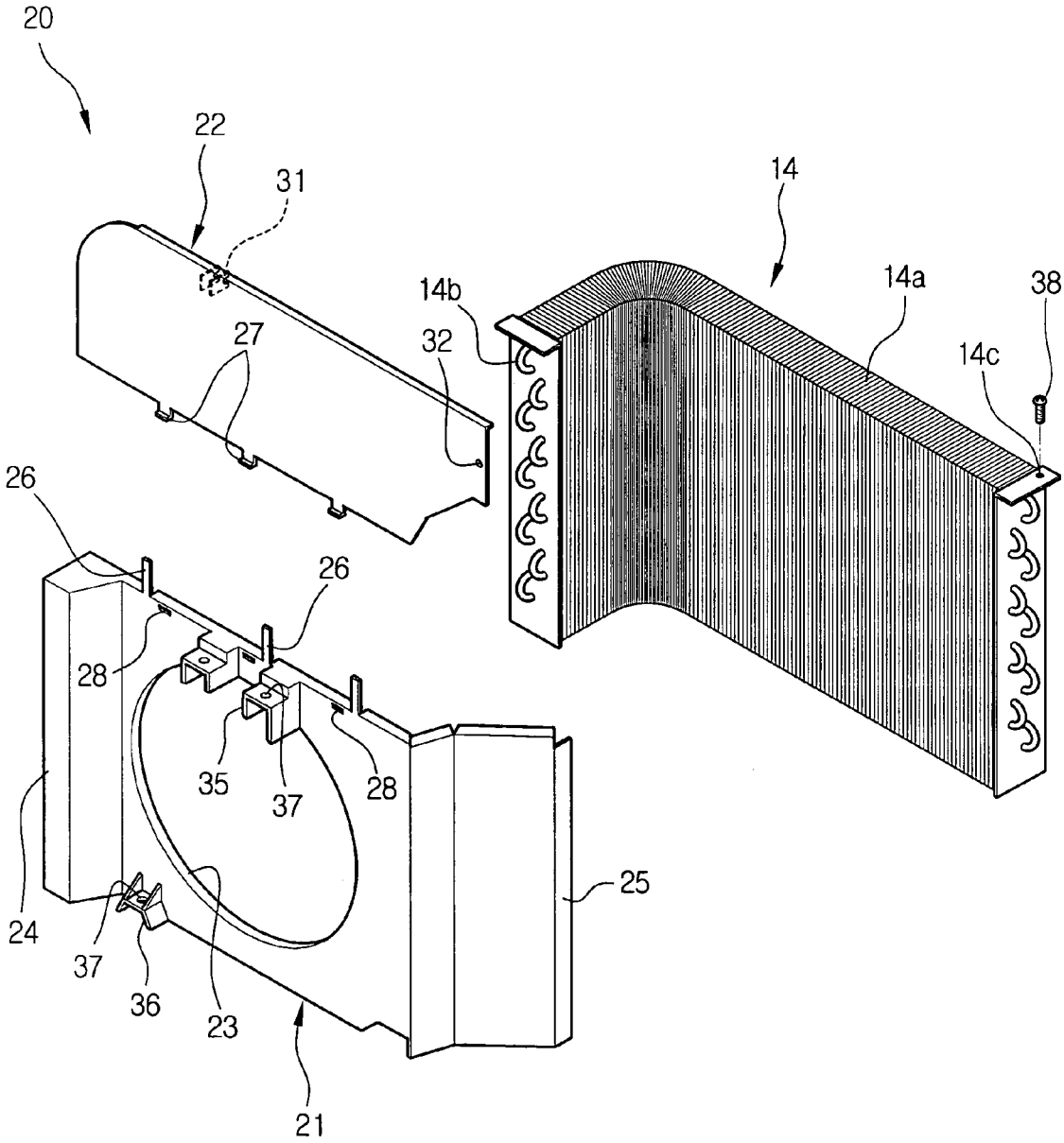
FIG. 3 illustrates a perspective view of an upper cover separated from a front plate of the condenser casing of FIG. 2, to house the condenser in the condenser casing.
Figure 4:
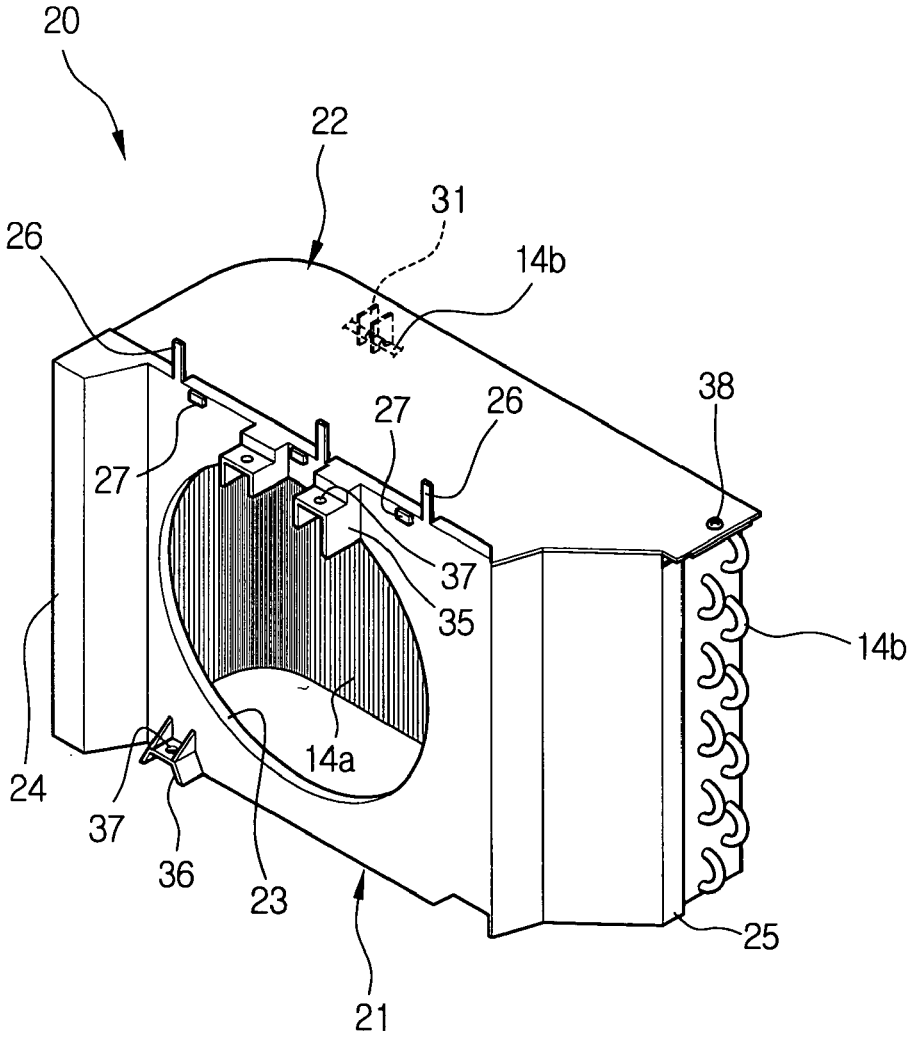
FIG. 4 illustrates a perspective view of the condenser assembled with the condenser casing of FIG. 3.
Figure 5:
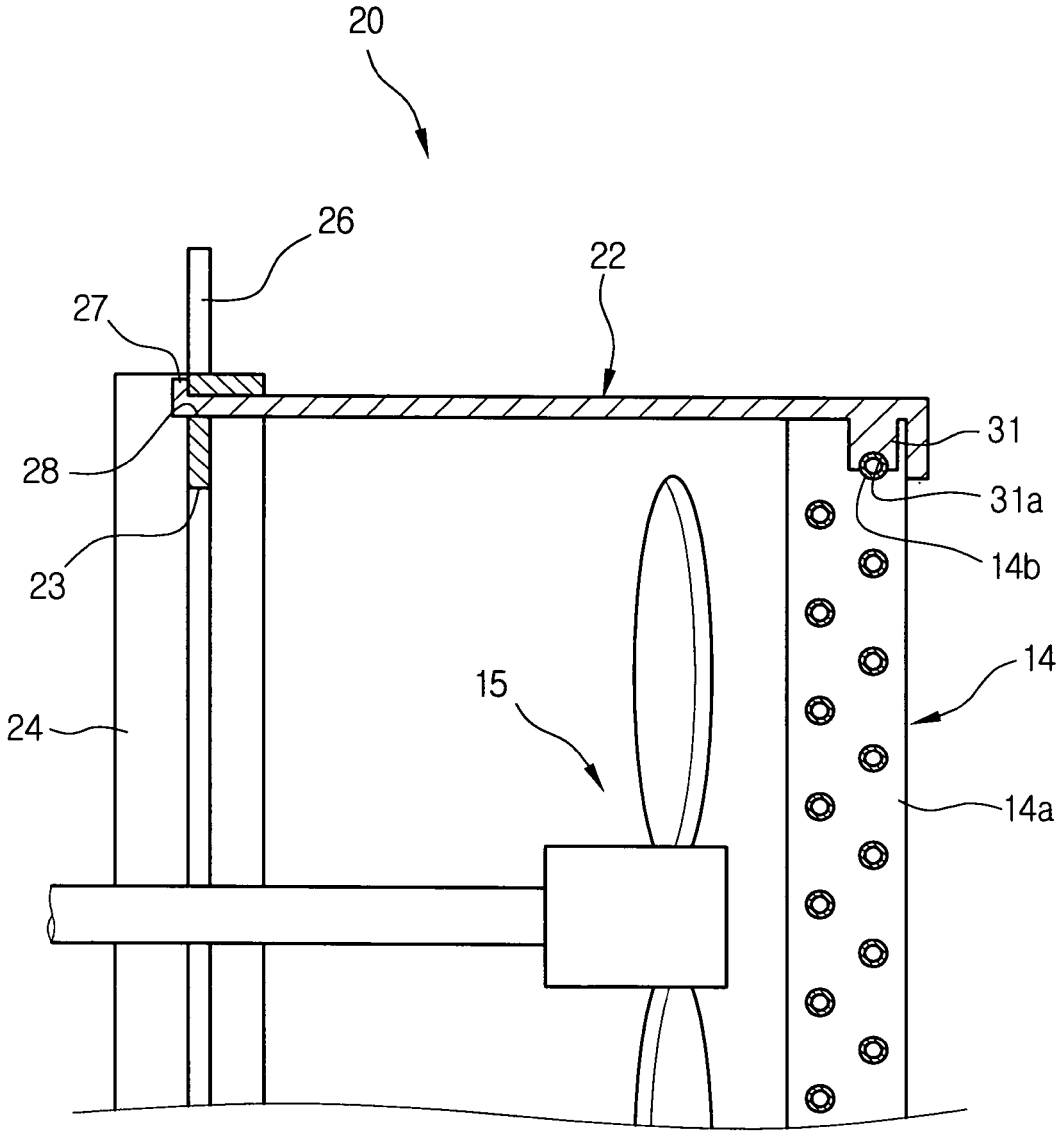
FIG. 5 illustrates a sectional view of the condenser and a condenser fan which are installed in the condenser casing of FIG. 4.

FIG. 2 illustrates a perspective view of the condenser 14 and the condenser casing 20 included in the integrated air conditioner of FIG. 1, prior to being assembled. FIG. 3 illustrates a perspective view of the upper cover 22 separated from the front plate 21 of the condenser casing 20 of FIG. 2, to house the condenser 14 in the condenser casing 20. FIG. 4 illustrates a perspective view of the condenser 14 assembled with the condenser casing 20 of FIG. 3. FIG. 5 illustrates a sectional view of the condenser 14 and the condenser fan 15 which are installed in the condenser casing 20 of FIG. 4.

As illustrated in FIG. 2, the condenser casing 20 includes the front plate 21, and the upper cover 22 which upwardly extends from the front plate 21. In this case, the front plate 21 and the upper cover 22 are integrally formed as a single structure.

The front plate 21 has an opening 23 at a center thereof in which the condenser fan 15 is set. Further, outdoor air flows through the inlet ports 17 of the cabinet 1 and the opening 23 to the condenser fan 15 which is set in the condenser casing 20. As shown in FIG. 2, the front plate 21 has a recess part 24 at a left side thereof to receive a bent left end of the condenser 14. At a right side of the front plate 21 is provided a cover part 25 to cover a right side of the condenser 14, thus preventing air from escaping from the right side of the condenser 14.

The upper cover 22 covers an upper end of the condenser 14 to allow air blown by the condenser fan 15 to efficiently pass through the condenser 14. When the front plate 21 and the upper cover 22 are produced before being assembled, the upper cover 22 and the front plate 21 are integrally formed as a single structure while being coupled to each other by a plurality of coupling pieces 26. The coupling pieces 26 are arranged along a horizontal direction between the front plate 21 and the upper cover 22, to be spaced apart from each other at regular intervals.

Each of the coupling pieces 26 is narrow and thin. Thus, when the coupling pieces 26 which are integrated with the front plate 21 and the upper cover 22, are bent forward and rearward, the coupling pieces 26 are easily cut, so that the upper cover 22 is separated from the front plate 21.

The condenser casing 20 also has a plurality of locking projections 27 and a plurality of locking holes 28 to firmly mount the upper cover 22 which is separated from the front plate 21, to the front plate 21. The locking projections 27 are provided along a front edge of the upper cover 22 to be spaced apart from each other at regular intervals. The locking holes 28 are provided along an upper edge of the front plate 21 to be spaced apart from each other at regular intervals, and receive the corresponding locking projections 27 therein.

As such, when the locking projections 27 are inserted into the corresponding locking holes 28 so that the upper cover 22 is mounted to the front plate 21, the condenser fan 15 is placed under the upper cover 22 at a position in back of the locking projections 27. Therefore, although a portion around a junction between the front plate 21 and the upper cover 22 is bent downward or deformed during a manufacturing or assembling process, the upper cover 22 does not come into contact with the condenser fan 15.

Since each of the locking projections 27 is shorter but thicker than each of the coupling pieces 26, the locking projections 27 are firmly integrated with the upper cover 22. Further, each of the locking projections 27 is upwardly projected at a front end thereof, thus preventing the locking projections 27 from being undesirably removed from the locking holes 28.

A hook 31 is downwardly projected from a left side of the upper cover 22 at a position around a rear edge of the upper cover 22, and a screw hole 32 is formed at a rear portion of the upper cover 22 at a position around a right side end of the upper cover 22, to mount the upper cover 22 to an upper portion of the condenser 14.

An upper bracket 35 and a lower bracket 36 are respectively provided on upper and lower portions of a front surface of the front plate 21 so that the condenser casing 20 is mounted at upper and lower portions thereof to the motor frame 7 and the base panel (see, FIG. 1) of the cabinet 1, respectively. Each of the upper and lower brackets 35 and 36 has a screw hole 37.

When the front plate 21 and the upper cover 22 of the condenser casing 20 are produced before being assembled, the front plate 21 and the upper cover 22 are integrally formed as a single structure while being coupled to each other by a plurality of coupling ribs 26. When it is desired to assemble the condenser casing 20 prepared as above, the upper cover 22 is bent forward and rearward repeatedly to be separated from the front plate 21. Thereafter, the front plate 21 is placed on the base panel of the cabinet 1, and screws are respectively tightened into the screw holes 37 of the upper and lower brackets 35 and 36. The front plate 21 is thus supported on the base panel of the cabinet 1 by the screws tightened to the base panel and the motor frame 7.

During the assembling of the condenser casing 20, the condenser fan 15 may be mounted to the drive motor 16 before the front plate 21 of the condenser casing 20 is installed on the base panel of the cabinet 1. In this case, the condenser fan 15 is installed in the condenser casing 20 through the opening 23 of the front plate 21, so that the front plate 21 is arranged in front of the condenser fan 15. Of course, after the front plate 21 is screwed to the motor frame 7 and the base panel of the cabinet 1, the condenser fan 15 may be mounted to the drive motor 16 through the opening 23 of the front plate 21.

After the front plate 21 is installed of the base panel of the cabinet 1, the condenser 14, which has a plurality of heat transfer fins 14*a* and a refrigerant pipe 14*b*, is placed in back of the front plate 21, and a lower end of the condenser 14 is mounted to the base panel of the cabinet 1. Thereafter, the upper cover 22 is mounted to the front plate 21. To mount the upper cover 22 to the front plate 21, a plurality of locking projections 27 which are provided along the front edge of the upper cover 22, are inserted into the corresponding locking holes 28 which are provided along the upper edge of the front plate 21. In this case, the front end of each of the locking projections 27 is projected upward, and the upper cover 22 is assembled with the front plate 21 to be perpendicular to the front plate 21.

Subsequently, when the upper cover 22 is locked to the condenser 14 using the hook 31 which is provided at a position around the rear edge of the upper cover 22, a semi-circular hook groove 31*a* (see, FIGS. 4 and 5) of the hook 31 is fitted over the refrigerant pipe 14*b* of the condenser 14. Next, a screw 38 is tightened into both the screw hole 32, which is provided on the rear portion of the upper cover 22, and a screw hole 14*c*, which is provided on an upper corner of a right side end of the condenser 14. Thus, as illustrated in FIG. 4, the assembly of the condenser casing 20, which houses the condenser fan 15 and the condenser 14 therein, is completed. Thereafter, the cover of the cabinet 1 is mounted on the base panel on which the condenser casing 20 is supported.

As illustrated in FIG. 4, when the condenser 14 is installed in the condenser casing 20, the upper cover 22 covers the upper portion of the condenser 14. Further, the recess part 24 of the front plate 21 covers the left side of the condenser 14, while the cover part 25 of the front plate 21 covers the right side of the condenser 14. Such a construction allows air to efficiently circulate through the condenser 14 by the condenser fan 15 which is placed in front of the condenser 14, as illustrated in FIG. 5. Therefore, the refrigerant flowing through the refrigerant pipe 14*b* of the condenser 14 is efficiently condensed.

As illustrated in FIG. 5, the condenser fan 15 is installed in the condenser casing 20 to be placed under the rear portion of the upper cover 22 at a position which is offset from the locking projections 27. Therefore, although the front end of the upper cover 22 may be bent downward or deformed when the condenser casing 20 is manufactured or assembled, or is used for lengthy periods, the condenser fan 15 never contacts the upper cover 22.

As apparent from the above description, the present invention provides an integrated air conditioner having a condenser casing, which is designed such that a plurality of locking projections provided on an upper cover to be spaced apart from each other at regular intervals, are inserted into corresponding locking holes provided on a front plate, and the upper cover is perpendicular to the front plate, thus preventing the upper cover from being deformed or broken so that the upper cover does not come into contact with a condenser fan, therefore preventing noise from being generated, in addition to preventing deformation or breakage of the condenser fan.

Further, in an integrated air conditioner having a condenser casing, a plurality of locking projections are positioned in front of the condenser fan. Thus, although a portion around the locking projections of the upper cover is deformed due to continued usage, the condenser fan does not come into contact with the upper cover, thus allowing the condenser fan to be semi-permanently and reliably operated without being damaged.

Further, according to the present invention, an integrated air conditioner having a condenser casing allows an upper cover to be easily mounted to a front plate, thus allowing for rapid assembly.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An integrated air conditioner including a condenser casing, to house a condenser and a condenser fan therein, comprising:

a front plate;

an upper cover; and a plurality of coupling ribs between the front plate and the upper cover, wherein the coupling ribs couple the upper cover to the front plate to form a single structure in which the upper cover upwardly extends from the front plate.

2. The integrated air conditioner according to claim 1, wherein the condenser casing further comprises:

a plurality of locking projections projected from a front edge of the upper cover toward the front plate; and a plurality of locking holes provided along an upper edge of the front plate to receive the locking projections therein, the locking projections being inserted into the corresponding locking holes to assemble the upper cover with the front plate after the coupling ribs are cut to separate the upper cover from the front plate.

3. The integrated air conditioner according to claim 2, wherein the locking projections are inserted into the locking holes in front of the condenser fan, which is provided under the upper cover, to operate the condenser fan at an offset position from the locking projections.

4. The integrated air conditioner according to claim 2, wherein each of the locking projections is shorter than each of the coupling ribs.

5. The integrated air conditioner according to claim 2, further comprising a hook, which is integrally projected from an inner surface of the upper cover at a position around a rear edge of the upper cover, to lock the upper cover to the condenser.

6. The integrated air conditioner according to claim 5, wherein the hook is provided with an arc-shaped groove corresponding to a shape of a refrigerant pipe to fit the hook over the refrigerant pipe.

7. The integrated air conditioner according to claim 5, further comprising a screw hole at a rear portion of the upper cover to screw the upper cover to an upper end of the condenser, thus allowing the upper cover to be locked to the condenser, in cooperation with the hook.

8. An integration type air conditioner, comprising:

a condenser casing, comprising:

a front plate;

an upper cover;

a plurality of locking projections integrally provided along a front edge of the upper cover; and a plurality of locking holes provided along an upper edge of the front plate to receive the locking projections therein, the locking projections being inserted into the locking holes to assemble the upper cover with the front plate while being perpendicular to the front plate, wherein the condenser casing further comprises a plurality of coupling ribs to temporarily couple the front plate to the upper cover.

9. An integration type air conditioner, comprising:

a condenser casing, comprising:

a front plate;

an upper cover;

a plurality of locking projections integrally provided along a front edge of the upper cover; and a plurality of locking holes provided along an upper edge of the front plate to receive the locking projections therein, the locking projections being inserted into the locking holes to assemble the upper cover with the front plate while being perpendicular to the front plate, wherein each of the coupling ribs is longer and thinner than each of the locking projections, the locking projections being inserted into the corresponding locking holes to assemble the upper cover with the front plate after the coupling ribs are cut.

10. An integrated air conditioner including a condenser casing, to house a condenser and a condenser fan therein, comprising:

a coupling rib;

a front plate, including an upper edge, having a locking hole along the upper edge; and an upper cover, having a locking projection, temporarily coupled to the front plate via a coupling rib, which is longer than the locking projection, wherein the locking hole receives the locking projection to lock the upper cover in place after the coupling rib is cut.

11. The integrated air conditioner according to claim 10, wherein the front plate and the upper cover are formed as a single structure while the upper cover is temporarily coupled to the front plate.

12. The integrated air conditioner according to claim 10, wherein the coupling rib is plural in number, the locking hole is plural in number, and the locking projection is plural in number.

13. The integrated air conditioner according to claim 12, wherein the coupling ribs are arranged along the upper edge of the front plate in a horizontal direction and are spaced apart at regular intervals.

14. The integrated air conditioner according to claim 13, wherein the locking projections are provided along the front edge of the upper cover and are spaced apart at regular intervals.

15. The integrated air conditioner according to claim 14, wherein the locking holes are provided along the upper edge of the front plate and correspond with the position of the locking projections.

16. The integrated air conditioner according to claim 10, wherein when the locking hole receives then locking projection, the condenser fan is under the upper cover and behind the locking projection, so that the upper cover does not come into contact with the condenser fan.

17. The integrated air conditioner according to claim 10, wherein the locking projection further comprises a front end, which is upwardly projected so that the locking projection is prevented from being undesirably removed from the locking hole.

18. The integrated air conditioner according to claim 10, further comprising:

a hook; and a rear edge of the upper cover, wherein the hook is integrally projected from an inner surface of the upper cover at a position around a rear edge of the upper cover to lock the upper cover to the condenser.

19. The integrated air conditioner according to claim 18, wherein the hook is provided with an arc-shaped groove corresponding to a shape of a refrigerant pipe which constitutes the condenser, to fit the hook over the refrigerant pipe.

20. A method of assembling a condenser casing, having a front plate including an upper edge, a locking hole along the upper edge, an upper cover, including a locking projection temporarily coupled to the front plate via a coupling rib, which is longer than the locking projection, and a coupling rib, wherein the locking hole receives the locking projection to lock the upper cover in place after the coupling rib is cut, comprising:

waggling the upper cover forward and backward relative to the front plate to sever the coupling rib;

partially inserting the locking projection into the locking hole;

rotating the upper cover downward and backward until the locking projection is fully inserted into the locking hole.

* * * * *